US006805161B2

(12) United States Patent
Zenker et al.

(10) Patent No.: US 6,805,161 B2
(45) Date of Patent: Oct. 19, 2004

(54) HYDRAULIC VALVE SYSTEM

(75) Inventors: Siegfried Zenker, Kirchseeon (DE); Thorkild Christensen, Sonderborg (DK)

(73) Assignee: Sauer-Danfoss ApS (DK)

( * ) Notice: Subject to any disclaimer, the term of this patent is extended or adjusted under 35 U.S.C. 154(b) by 0 days.

(21) Appl. No.: 10/422,209

(22) Filed: Apr. 24, 2003

(65) Prior Publication Data

US 2003/0205278 A1 Nov. 6, 2003

(30) Foreign Application Priority Data

May 2, 2002 (DE) ..... 102 19 718

(51) Int. Cl.[7] ..... F15B 13/04

(52) U.S. Cl. ..... 137/596.2; 91/420; 91/436; 91/451; 137/493.4

(58) Field of Search ..... 91/420, 436, 451; 137/493.4, 596.2

(56) References Cited

U.S. PATENT DOCUMENTS

| | | | | |
|---|---|---|---|---|
| 4,693,272 A | | 9/1987 | Wilke | |
| 4,787,294 A | | 11/1988 | Bowden | |
| 5,138,837 A | | 8/1992 | Obertrifter et al. | |
| 5,159,872 A | * | 11/1992 | Dettmers et al. | 91/449 |
| 5,315,826 A | | 5/1994 | Hirata et al. | |
| 5,715,865 A | | 2/1998 | Wilke | |
| 6,267,141 B1 | | 7/2001 | Rivolier | |
| 6,318,079 B1 | | 11/2001 | Barber | |
| 6,477,937 B1 | * | 11/2002 | Horn et al. | 137/596.2 |
| 6,581,639 B2 | * | 6/2003 | Fiala et al. | 137/596.2 |

FOREIGN PATENT DOCUMENTS

| | | |
|---|---|---|
| DE | 19640103 | 12/1998 |
| DE | 19919015 | 4/2001 |
| DE | 10033757 | 1/2002 |
| EP | 0 877 975 B1 | 11/1998 |

* cited by examiner

*Primary Examiner*—Gerald A. Michalsky

(57) ABSTRACT

A hydraulic valve system (1) has a supply connection arrangement, having a high-pressure connection (P) and a low-pressure connection (T), a working connection arrangement, having two working connections (A, B), which can be connected with a hydraulic motor (2), and a directional valve (4) between the supply connection arrangement (P, T) and the working connection arrangement (A, B), which is connected with the working connection arrangement (A, B) via working lines (17, 18), in which are arranged check valves (21, 22), which can be opened by means of pressure.

7 Claims, 2 Drawing Sheets

HYDRAULIC VALVE SYSTEM

BACKGROUND OF THE INVENTION

The invention concerns a hydraulic valve system with a supply connection arrangement, having a high-pressure connection and a low-pressure connection, a working connection arrangement, having two working connections, which can be connected with a hydraulic motor, and a directional valve between the supply connection arrangement and the working connection arrangement, which is connected with the working connection arrangement via working lines, in which are arranged check valves, which can be opened by means of pressure.

Such a valve system is known from, for example, DE 199 19 105 C2. In dependence of the desired operation direction, the directional valve controls a path for pressurised hydraulic fluid from the high-pressure connection to one of the two working connections and from the other of the two working connection to the low-pressure connection. If required, also a throttling resistance is influenced by the position of the slide of the directional valve, said throttling resistance determining, together with the pressure ruling over the directional valve, the amount of hydraulic fluid per time unit to the motor.

The use of check valves in the working lines has the advantage that the motor is protected against unintentional movements. In particular, the check valves ensure that external loads cannot move the motor connected to the working connections, unless the operator intentionally influences this. Only when the pressures available in the system open the check valves, a movement of the motor is possible, that is, also with negative loads, when the load has to be lowered.

A problem in this connection is, however, the fact that a supply failure, for example a defect in a pump or in a combustion motor driving a pump, causes that the motor connected to the valve system can no longer be operated at all. When, for example, this motor has lifted a load, it is relatively difficult to find a safe way of returning this load to a position, in which the operating staff is no longer endangered.

SUMMARY OF THE INVENTION

The invention is based on the task of avoiding such dangerous situations in connection with supply failures.

In a hydraulic valve system as mentioned above, this task is solved in that a flow control valve is arranged in at least one working line.

By means of the flow control valve, a fluid path from the motor, that is, from a working connection, to the low-pressure connection can be opened intentionally, to enable the lowering of a load. As long as the motor can put pressure on the working connection, the activation of the flow control valve makes it possible to relieve this load, that is, to let fluid flow off from the motor. This makes it possible, for example, to lower loads so much that they are supported on a foundation, and that a pressure generation no longer occurs at the working connection. Thus, the check valves no longer have to be opened to effect such a relief. On the contrary, an additional valve is used, namely the flow control valve.

It is preferred that the flow control valve is activated by means of a handle. Thus, it is not even necessary any longer to produce an additional hydraulic pressure to activate the flow control valve. The flow control valve can be opened by a direct and immediate intervention from the outside.

The handle is in the form of a threaded spindle. By means of a threaded spindle, a very delicate control of the opening movement of the flow control valve is possible. When, for example, a relatively low pitch of the thread of the threaded spindle is chosen, it is possible, by means of a delicate turning of the threaded spindle, to effect a similarly delicate opening of the flow control valve. Particularly with heavy loads, a delicate opening of the flow control valve is extremely advantageous, as this enables lowering of the load at a high accuracy and a low speed in a controlled manner.

The flow control valve is integrated in a pressure relief valve system. Thus, additional component groups can be saved, which should otherwise be arranged in the valve system. In particular, it is not required to establish additional lines, when the valve system already comprises a pressure relief valve system. However, a pressure relief valve is comprised in most hydraulic valve systems anyway, to avoid an overloading of the valve system.

The pressure relief valve system has a valve, which is both pressure-operable as pressure relief valve and manually operable as flow control valve. Thus, only one valve is used, which has, however, two functions, and which can be opened in different ways. On the one side, the valve opens, when the pressure in a pressure chamber gets too high, to effect a pressure relief at an overpressure. In a second function, this valve can, on the other side, also be opened to effect a manual lowering of a load connected to a working connection. In this case, in fact only one additional operation option is required, for example a handle, which acts upon the valve element of the valve to open the valve.

Also, the pressure relief valve system is designed with an integrated anti-cavitation valve. Such a system is known from, for example, DE 196 00 275 A1. The combination of the pressure relief valve with an anti-cavitation valve saves space and simplifies the piping arrangement. When a third function is additionally integrated in this valve, there will be sufficient opportunities of securing the valve system against overpressures on the one side, and of providing safety measures against inoperability of the valve on pressure failure on the other side.

In addition, the pressure relief valve has a valve element, which bears on a valve seat, an auxiliary valve element bearing on an auxiliary valve seat, which is formed in the valve element, the auxiliary valve element being operable from the outside. The auxiliary valve element being operable from the outside thus realises the function of the flow control valve, that is, when the auxiliary valve element is lifted from the auxiliary valve seat, the pressurised hydraulic fluid at the working connection can escape. Usually, this pressure is not sufficient to open the pressure relief valve. When, however, the pressure relief valve is supported by the handle, also lower pressures will be sufficient to lower the load.

It is particularly preferred that the auxiliary valve element is fixed to an operating rod, and is pressed against the valve element by a spring from the side, on which also the valve seat bears, the handle acting upon the auxiliary valve element against the force of the spring via the rod. Compared with the valve known from DE 196 00 275 A1 only slight changes are required. Actually, only a handle must be provided to act upon the rod, on which the auxiliary valve element is fixed. This embodiment is effective and can be realised at relatively low costs.

Further, the handle can be used as a lift limitation for the anti-cavitation valve. The position of the handle thus determines the opening width of the anti-cavitation valve. Thus, for example when controlling a negative load, the feeding speed can be influenced by the anti-cavitation valve, meaning that the pressure relief valve with integrated anti-cavitation and flow control valves gets an additional function.

DESCRIPTION OF THE PREFERRED EMBODIMENT

Figure 1:
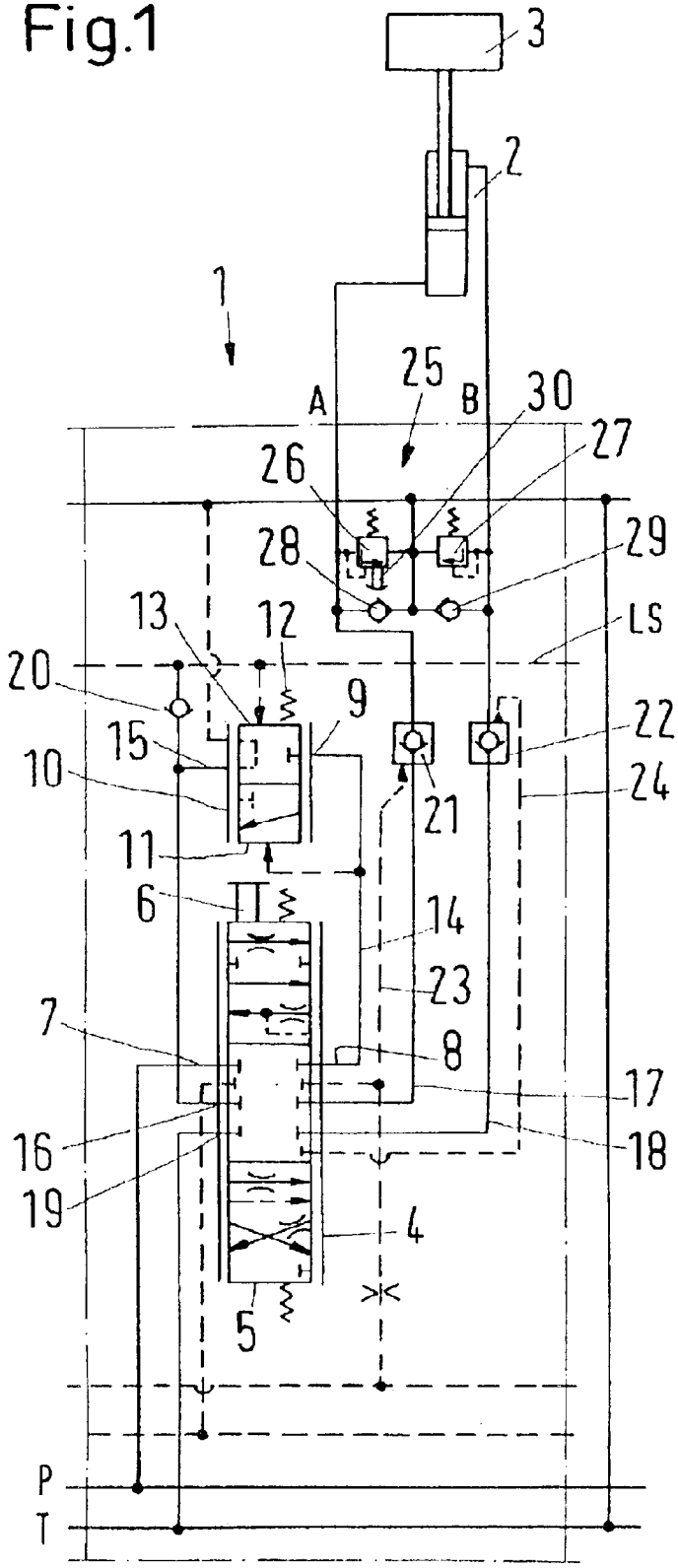
FIG. 1 is a schematic drawing of a hydraulic valve system of this invention.

With reference to FIG. 1, a hydraulic valve system 1 has a supply connection arrangement with a high-pressure connection P and a low-pressure connection T. In many cases, such hydraulic valve systems are operated in parallel with additional hydraulic valve systems (not shown), so that the high pressure connection P and the low pressure connection T are made as looped lines, that is, additional hydraulic valve systems can be connected to these connections. Further, the valve system 1 has two working connections A, B, to which a hydraulic motor 2, for example a hydraulic piston-cylinder system, can be connected. For example, the motor 2 serves the purpose of lifting a load 3.

Between the supply connection arrangement P, T and the working connection arrangement A, B is arranged a directional valve 4, which has a slide 5, which is displaceable by means of a handle 6 or a drive, for example a magnetic or hydraulic drive. The directional valve 4 has a first inlet 7, which, on a displacement of the slide 5 (independently of the direction), is connected with a first outlet 8. The first inlet 7 is connected with the high-pressure connection P.

The first outlet 8 is connected with an inlet 9 of a compensation valve 10. The compensation valve 10 has a slide 11, which is acted upon in the closing direction (shown position) by a spring 12 and a pressure in a pressure chamber 13, which is connected with a load-sensing line LS. The load-sensing line LS carries the highest pressure existing in the system, that is, under certain circumstances a pressure, which is higher than the highest pressure existing in the valve system 1.

The other side of the slide 11 is acted upon by the pressure in the line 14 between the first outlet 8 of the directional valve and the inlet 9 of the compensation valve 10.

The compensation valve 10 has an outlet 15, which is connected with a second inlet 16 of the directional valve 4. Depending on the position of the slide 5, this second inlet 16 is connected with one of two working lines 17, 18, which are connected with the working connections A, B. The other of the working lines 18, 17, which is not connected with the second inlet 16, is then connected with a low-pressure inlet 19, which is connected with the low-pressure connection T.

Via a non-return valve 20, the outlet 15 of the compensation valve 10 is connected with the load-sensing line LS, the non-return valve 20 opening in the direction of the load-sensing line LS, so that, when the highest pressure existing in the system rules at the compensation valve 10, this pressure is reported to the load-sensing line LS by the non-return valve 20.

The compensation valve 10 forms a pressure balance for pressure control valve and keeps the pressure over the directional valve constant.

In the working line 17 is arranged a check valve 21 and in the working line 18 a check valve 22. The check valves 21, 22 are normally closed. The pressure in the corresponding working line 17, 18, opens them.

As always only one of the two working lines 17, 18 is carrying pressure, whereas the other working line 18, 17 is acted upon by a pressure in the order of magnitude of the low-pressure connection T, the check valve 21 has a control line 23 and the check valve 22 a control line 24, so that the pressures in the control lines 23, 24 can also ensure that the check valves 21, 22 are opened.

Between the working connections A, B, that is, between the working lines 17, 18, is provided a pressure relief and anti-cavitation valve system 25, which initially has two tasks. The pressure relief and anti-cavitation valve system 25 has two pressure relief valves 26, 27 and two anti-cavitation valves 28, 29, connecting in pairs the working lines 17, 18 with the low-pressure line T. The pressure relief valves 26, 27 bleed pressure, when the pressure at the working connections A, B gets too high. Via the anti-cavitation valves 28, 29 it is possible to refill hydraulic fluid from the low-pressure connection T, when a lack of fluid exists.

Additionally, the pressure relief valve 26 connected with the working connection A has a handle 30, which makes it possible to control the opening of the flow-control valve 26 with a very delicate movement. This opening is a large advantage, when the pressure at the high-pressure connection P, for whatever reason, fails. Without a pressure at the high-pressure connection P it is not possible to operate the compensation valve 10 and open the check valves 21, 22. It would thus not be possible to lower a lifted load. On the contrary, the lifted load 3 would remain in its lifted position, which could lead to dangerous situations.

In principle, it is possible to provide both pressure relief valves 26, 27 with a handle 30, which enables a controlled bleeding of pressure from the motor 2, that is, a reduction of a pressure at the working connection A, B. However, such a handle is only required for the one of the pressure relief valves 26, 27, which can in fact be exposed to a pressure from an external load 3, when the pressure from the high-pressure connection P fails.

Figure 2:
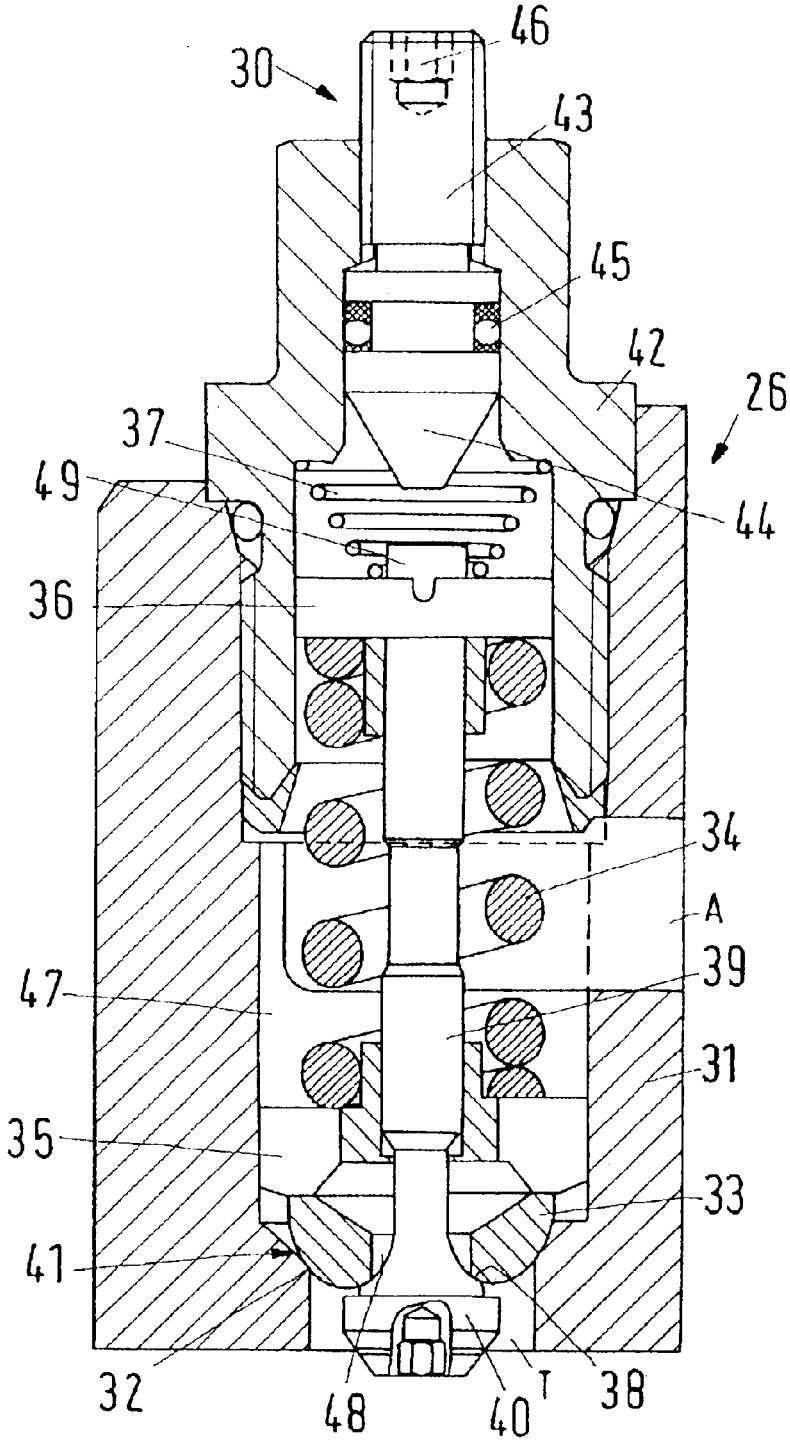
FIG. 2 is a schematic cross-sectional view through the pressure relief valve with integrated anti-cavitation and flow control valves.

The schematic design of such a pressure relief valve 26 is shown in detail in FIG. 2. The pressure relief valve 26 has a housing 31, in which is arranged a valve seat 32. A valve element 33 bears on the valve seat 32, said valve element 33 being stressed against the valve seat 32 by a compression spring 37. The spring 37 acts via a support plate 36, a compression spring 34 and a distance piece 35 upon the valve element 33. The spring 34 is supported on the distance piece 36, which is supported on a housing insert 42 via a spring 37. Basically, the valve element 33 can be lifted off from the valve seat 32 against the force of the spring 37, which is substantially weaker than the spring 34.

In the valve element 33 is provided an auxiliary valve seat 38, through which is led a rod 39, on whose one end is arranged an auxiliary valve element 40. Thus, the auxiliary valve element 40 bears on the same closing face 41 of the valve element 33 as the valve seat 32 of the housing 31.

At the other end of the rod 39 the support plate 36 is arranged. The support plate 36 is fixed on the rod 39 in at least one direction against the force of the spring 34, so that the auxiliary valve element 40 is stressed against the auxiliary valve seat 38 by the force of the spring 34.

A housing insert 42 is screwed into the end of the housing 31 facing away from the valve seat 32, a threaded spindle 43 being screwed into said housing insert 42. On the end facing the rod 39, the threaded spindle 43 has a conical head 44, which can be moved towards and away from the rod 39. The threaded spindle is sealed in relation to the housing insert 42 by means of schematically shown sealings 45. It has a torque action face 46, for example a hexagon socket, by means of which the threaded spindle 43 can be turned in the housing insert 42 and thus in relation to the housing 31, so that it can be moved in the axial direction.

The pressure relief valve 26, which combines the functions of a pressure relief valve, an anti-cavitation valve and a flow control valve, works in different modes of operation as follows, assuming that a pressure chamber 47 is always connected with the working connection A, while the valve seat 31 and the auxiliary valve seat 38 are connected with the low-pressure connection T: Usually, the valve element 33 bears on the valve seat 32 and the auxiliary valve element 40 bears on the auxiliary valve seat 38. The pressure chamber 47 is exposed to the pressure at the working connection A.

When the pressure at the working connection A drops below the pressure at the low-pressure connection T and the pressure difference is large enough to overcome the force of the spring 37, the pressure at the low-pressure connection T lifts the valve element 33 off from the valve seat 32, and the pressure chamber 47 can be filled with hydraulic fluid from the low-pressure connection T, so that cavitation is avoided. This is the function of the anti-cavitation valve 28.

In an operation case, in which the pressure relief valve 26 must avoid an overpressure, it is assumed that a large pressure rules in the pressure chamber 47. In this case, the pressure propagates from the pressure chamber 47 via a bore 48 in the valve element 33 to the auxiliary valve element 40 and lifts the auxiliary valve element 40 off from the auxiliary valve seat 38. The excess pressure can then escape to the low-pressure connection T. For this purpose, the distance piece 35 is provided with recesses (not shown in detail).

When, however, the supply pressure drops, so that a pressure controlled operation of the check valves 21, 22 is no longer possible, the handle 30 can be activated by turning the threaded spindle 43 into the housing insert 42. After a certain distance, the conical head 44 will come to rest on the end 49 of the rod 39, pressing, via the rod 39, the auxiliary valve element 40 away from the valve seat 38. As the threaded spindle 43 only travels a relatively short axial distance per rotation, the lifting of the auxiliary valve element 40 from the auxiliary valve seat 38 can be controlled relatively accurately, and thus also the amount per time unit, which can flow off through the "auxiliary valve" formed by the auxiliary valve seat 38 and the auxiliary valve element 40. In this way, a very accurately controllable movement of the load 3 is possible, at least in the lowering direction.

When the load 3 has been lowered enough, and, for example, rests on a stable foundation, the threaded spindle 43 is turned back to its original position and the auxiliary valve again works as a "normal" pressure relief valve.

However, the handle 30 can have another function: the handle 30, that is, the conical head 44 of the threaded spindle 43 defines the magnitude of the opening path, when the valve element 33 lifts off from the valve seat 32. By means of the position of the threaded spindle 43, it is possible, within certain limits, to set the extent, to which the anti-cavitation valve 28 can refill.

It is therefore seen that this invention will achieve at least all of its objectives.

What is claimed is:

1. A hydraulic valve system with a supply connection arrangement, having a high-pressure connection and a low-pressure connection, a working connection arrangement, having two working connections, which can be connected with a hydraulic motor, and a directional valve between the supply connection arrangement and the working connection arrangement, which is connected with the working connection arrangement via working lines, in which are arranged check valves, which can be opened by means of pressure, characterised in that a flow control valve (26) is arranged in at least one working line (17, 18), the flow control valve (26) being integrated in a pressure relief valve arrangement (25) having a valve, which is both pressure-operable as pressure relief valve and manually operable as flow control valve.

2. A valve system according to claim 1, characterised in that the flow control valve (26) is activated by means of a handle (30).

3. A valve system according to claim 2, characterised in that the handle (30) is in the form of a threaded spindle (43).

4. A valve system according to claim 1, characterised in that the pressure relief valve arrangement (25) is designed with an integrated anti-cavitation valve (28, 29).

5. A valve system according to claim 1, characterised in that the pressure relief valve (26) has a valve element (33), which bears on a valve seat (32), an auxiliary valve element (40) bearing on an auxiliary valve seat (38), which is formed in the valve element (33), the auxiliary valve element (40) being operable from the outside.

6. A valve system according to claim 5, characterised in that the auxiliary valve element (40) is fixed to an operating rod (39), and is pressed against the valve element (33) by a spring (34) from the side, on which also the valve seat (32) bears, the handle (30) acting upon the auxiliary valve element (40) against the force of the spring (34) via the rod (39).

7. A valve system according to claim 6, characterised in that the handle (30) can be used as a lift limitation for an integrated anti-cavitation valve.

* * * * *